US005343674A

United States Patent [19]

Brown

[11] Patent Number: 5,343,674

[45] Date of Patent: Sep. 6, 1994

[54] RACING SADDLE

[75] Inventor: Roy L. Brown, Nevada, Mo.

[73] Assignee: Ortho-Flex Saddle Co., Inc., Nevada, Mo.

[21] Appl. No.: 130,240

[22] Filed: Oct. 1, 1993

[51] Int. Cl.[5] ..... B68C 1/00

[52] U.S. Cl. ..... 54/44.1

[58] Field of Search ..... 54/44.1, 44.3, 44.5, 54/44.7, 66

[56] References Cited

U.S. PATENT DOCUMENTS 359,176 3/1887 Quintero ..... 54/44.4

4,965,988 10/1990 Anderson ..... 54/44.7

*Primary Examiner*—Thomas Price

*Attorney, Agent, or Firm*—Hovey, Williams, Timmons & Collins

[57] ABSTRACT

An improved saddle tree is provided, which flexibly confirms to a horse's back to accommodate the physically characteristics of a given horse, and incorporates a damping system to preclude excessive vibrations in the flexible materials. The saddle tree includes a pair of laterally spaced apart, flexible synthetic skirts connected by a spanning member and a seat element. The seat element is coupled with the respective skirts at two forward pivot mountings, and the spanning member extends between the skirts at a rearward position. The seat element carries a skid assembly at a position just rearward of the pommel, and this assembly deforms under compressive loading to provide damping action. The cantle portion of the seat element slidably and frictionally engages the top of the spanning member.

12 Claims, 3 Drawing Sheets

RACING SADDLE

BACKGROUND OF THE INVENTION

1. Field of the Invention

The present invention is broadly concerned with an improved saddle tree assembly that is progressively loaded at several points to flexibly conform with the body contours of a horse, and damps vibrations traveling between the horse and rider. More particularly, it is concerned with such a tree assembly including a pair of resilient skirts adapted to conformably overlie a horse's back, a spanning element coupled with each of the skirts, a seat member positioned above the skirts and slidably engaging the spanning element, and means for coupling the seat member to the skirts in a manner allowing pivotal motions at the coupling. The seat member has a resiliently deformable seat intermediate the pommel and cantle portions, and the seat member provides means for damping vibrations traveling between the horse and rider.

2. Description of the Prior Art

A major problem in saddling is that rigid saddle tree constructions tend to concentrate weight over the wither shoulder area of the horse. Bruising of the horse's back is likely to result whenever contact points between the back and saddle are loaded with a pressure greater than 1¼ pounds per square inch. Excessive weight concentration can further lead to the development of sores, pinching of the withers, and other painful conditions that can induce disastrous results in the physiology and riding mechanics of the horse.

Another problem in the equestrian arts is the development of soreness due to the constant pounding that results from stepping movements on the horse's part. These pounding forces contribute to injuries in both the rider and the horse.

U.S. Pat. No. 4,745,734 represents a significant breakthrough in the art, in that it provides a flexible saddle which distributes the combined weight of saddle and rider over a large surface area on a horse's back, thereby minimizing injuries to the horse. This weight distribution is accomplished through the deformation of flexible skirts that conform to a horse's back and contact the same over a large surface area. Nevertheless, the '734 patent provides for a saddle having two spanning elements that are affixed to flexible skirts at four points (two opposed forward and two opposed rearward points). This four-point connection rigidifies the underlying skirts intermediate the respective points of connection. Additionally, the respective skirts have a forwardly extending portion that is formed as a single rounded piece, and this construction rigidifies the tree in the crucial wither-shoulder region of the horse. This rigidity makes the skirts less able to conform to the body contours of the horse and less able to reduce the magnitude of pounding forces transmitted from the horse to the rider.

SUMMARY OF THE INVENTION

The present invention overcomes the problems described above and provides a greatly improved saddle tree assembly having structure permitting improved flexion capabilities that protect both the horse and the rider from injury. The saddle tree also incorporate a damping mechanism to prevent the improved flexion capabilities from causing uncontrolled oscillatory vibrations.

In more detail, the saddle tree assembly of the invention includes a pair of laterally spaced apart skirts preferably formed of synthetic resin material (e.g. Delrin), with a spanning element attached to each skirt. A seat member is positioned above the skirts and spanning element to slidably engage the spanning element, and is coupled with the skirts by means allowing pivotal or rocking motions of the skirts relative to the seat member. The seat element has a resiliently deformable seat region intermediate the relatively more rigid pommel and cantle portions of the seat. This seat region provides structure, such as elastomeric cushions and frictional contacts, for damping vibrations traveling between the horse and rider.

This damping action occurs by several mechanisms. A mechanical hysteresis damping is caused by the flexion of the skirts and seat element. Flexion in the seat element causes lateral sliding motion of the cantle over the spanning element, where frictional forces convert vibrational energy into heat, and the elastomeric cushions may resiliently deform to absorb vibrational energy.

In practice, each of the skirts preferably includes a forward portion having a greater width than a rearward portion, where the forward and rearward portions are connected by an intermediate portion having a width less than the rearward portion. Additionally, the forward portion has a number of forwardly extending fingers that are connected to a strap of material extending across all of the fingers, and each skirt preferably has a stiffening assembly affixed thereto.

Most preferably, the spanning element attaches to the rearward portion of each skirt, and the cantle seat portion slidably engages the top of the spanning element. A coupling assembly connects the forward portions of the skirts with the seat element. The coupling assembly includes: structure defining a mounting hole through each respective skirt and having a mounting hole therethrough; a arcuate member affixed to the seat portion presenting a convex face proximal to the skirt and having a central threaded aperture; and a connective member having a head retained from moving into the mounting hole and a threaded body retained within the threaded aperture. The head of the connective member may pivot and/or slide within the mounting hole. A skid assembly is positioned intermediate the spanning element and the coupling means, wherein the skid assembly includes a resilient cushion extending downwardly from the seat portion to contact the skirt. The skirt may be provided with a skid plate to receive the cushion, which functions to absorb shocks and distribute a compressive load onto the skid plate. Additionally, a stirrup mounting structure, such as a slot for receiving a leather thong, is positioned intermediate the coupling assembly and the skid assembly.

DETAILED DESCRIPTION OF THE PREFERRED EMBODIMENT

Figure 1:
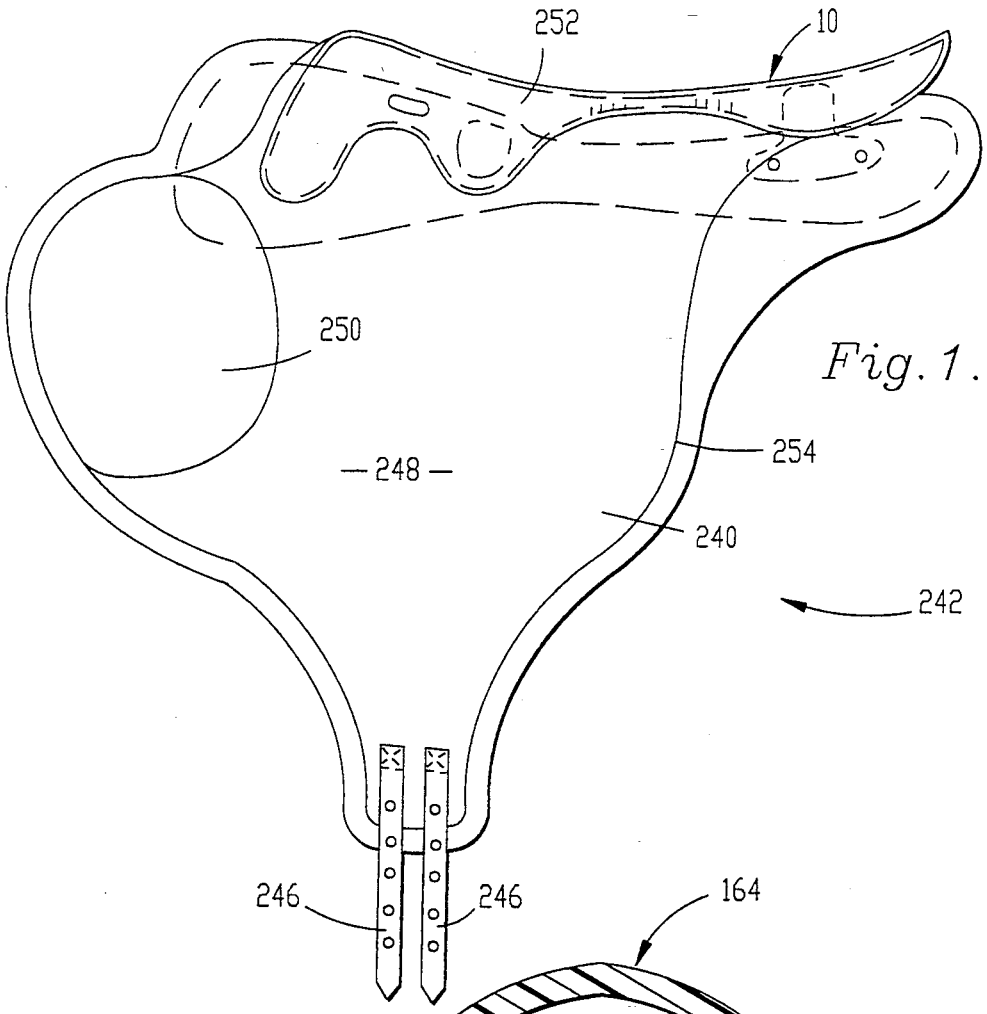
FIG. 1 is a perspective side view of a saddle having a tree in accordance with the invention.

Turning now to the drawings, a saddle tree assembly of English styling is illustrated in FIGS. 1–6. Broadly speaking, saddle tree 10 (FIG. 2) includes a pair of laterally extending skirts 12 and 14 (FIGS. 3 and 4) formed in a mirror image with respect to each other and adapted to overlie a horse's back, spanning element 16 (FIG. 6) connecting skirts 12 and 14, an overlying seat member 18 (FIG. 2), and a coupling assembly 20 (FIG. 4) connecting element 18 to the respective skirts 12 and 14.

Figure 2:
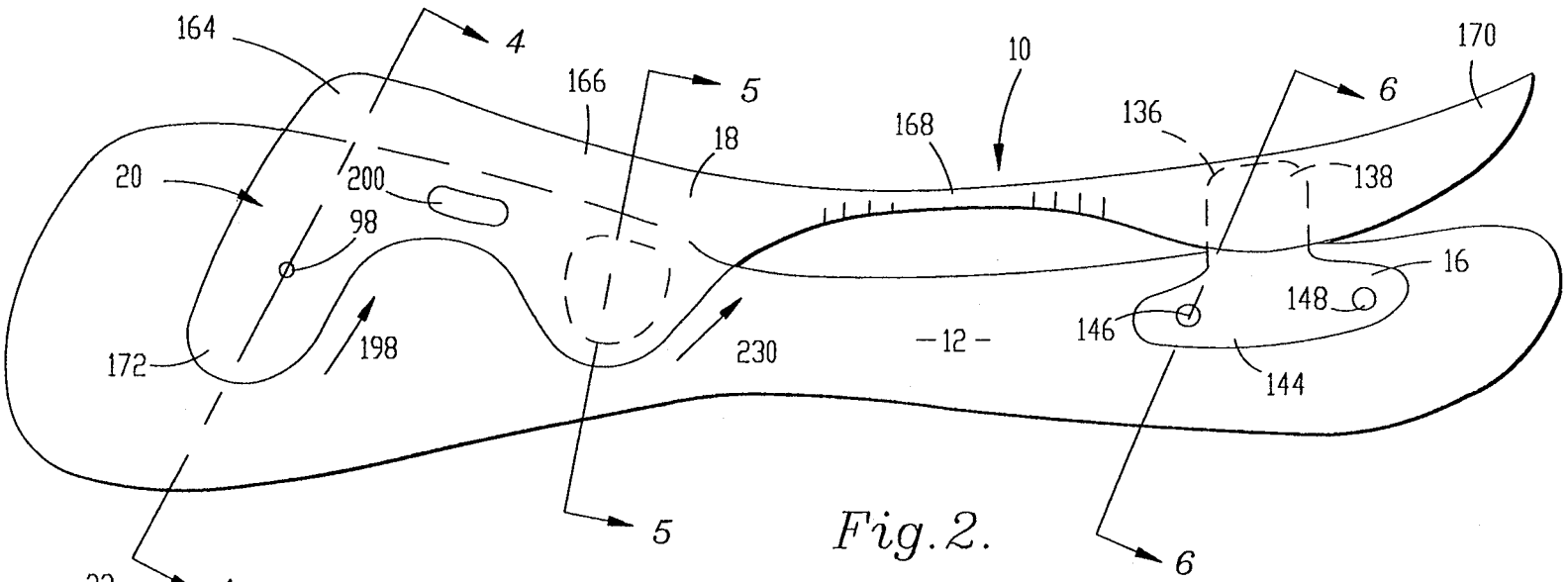
FIG. 2 is a schematic side view of the saddle tree of FIG. 1.

In more detail, each of skirts 12 and 14 is a mirror image of the other, and each is preferably formed of synthetic resin, except as otherwise specified below. FIG. 2 schematically depicts skirt 12 in place with respect to seat member 18, and FIG. 3 depicts skirt 12 in greater detail.

Figure 3:
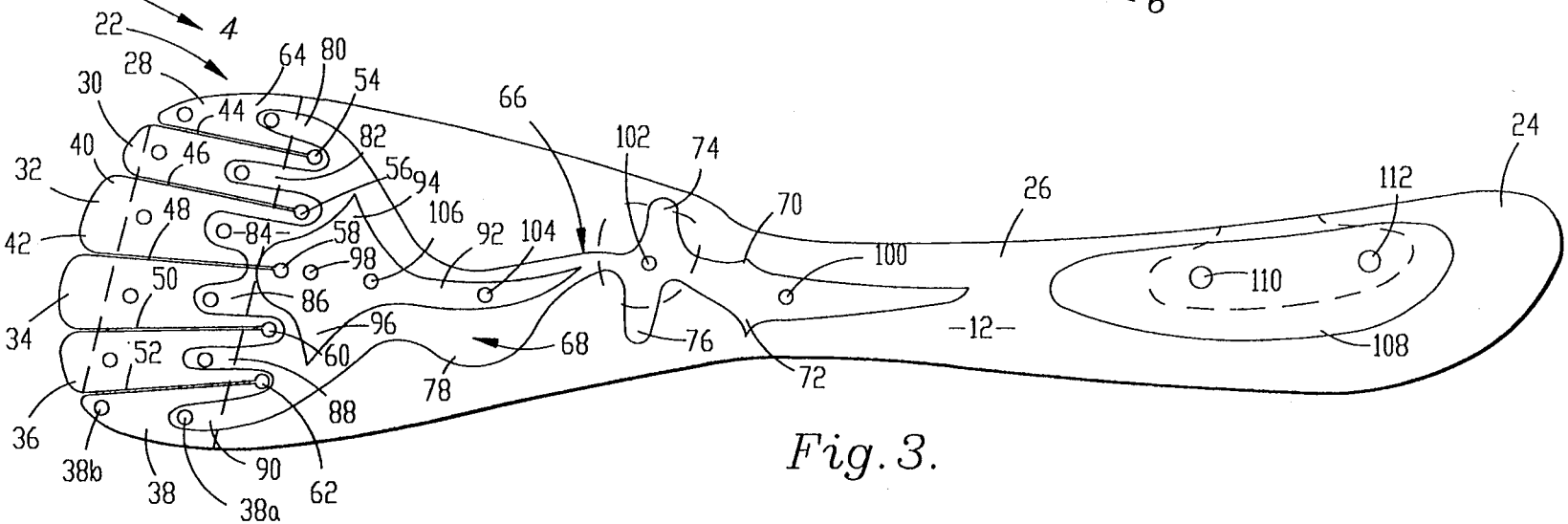
FIG. 3 is a top view illustrating a skirt from FIG. 2, and showing the skirt in additional detail including the forwardly extending fingers thereof.

Turning now to FIG. 3, skirt 12 presents a forward portion 22 having the greatest width, a rearward portion 24 having the second greatest width, and a narrowed connective intermediate portion 26 having a width narrower than the width of portion 24. Forward portion 22 has a plurality of forwardly extending fingers 28, 30, 32, 34, 36, and 38, each having rounded edges (e.g., 40 and 42). The respective fingers are separated by laterally extending marginal cuts, 44, 46, 48, 50, and 52 where the rearmost end of each cut forms a rounded aperture 54, 56, 58, 60, and 62. The respective fingers 28–38 are each riveted in two positions, e.g., **38*a* and 38*b*, to a single leather or elastomeric strap 64** that extends transversely across the fingers, thereby interconnecting the same.

Skirt 12 includes stiffener 66, which has a first layer 68 presenting various reinforced regions including projections 70, 72, 74, 76, 78, 80, 82, 84, 86, 88, and 90. These projections stiffen skirt 12 to better distribute the load over the entirety of forward portion 22, which will be fastened proximal to the wither-shoulder region of a horse. Second layer 92 having pointed projections 94 and 96 is a metallic stiffener that overlies a portion of first layer 68 (and the general wither shoulder region of the horse that is subjected to the greatest loading) to enhance the stiffening and weight distribution function of the underlying layer 68. Mounting hole 98 extends through second layer 92, first layer 68, and skirt 12 (see FIG. 4). Metal rivets 100, 102, 104, and 106, fasten layers 92 and 68 to skirt 12. Additionally, a metal rivet, e.g., **38*a*, fastens each of fingers 80–90 to skirt 12, in addition to fastening fingers 28–38 to strap 64** as described above.

Figure 4:
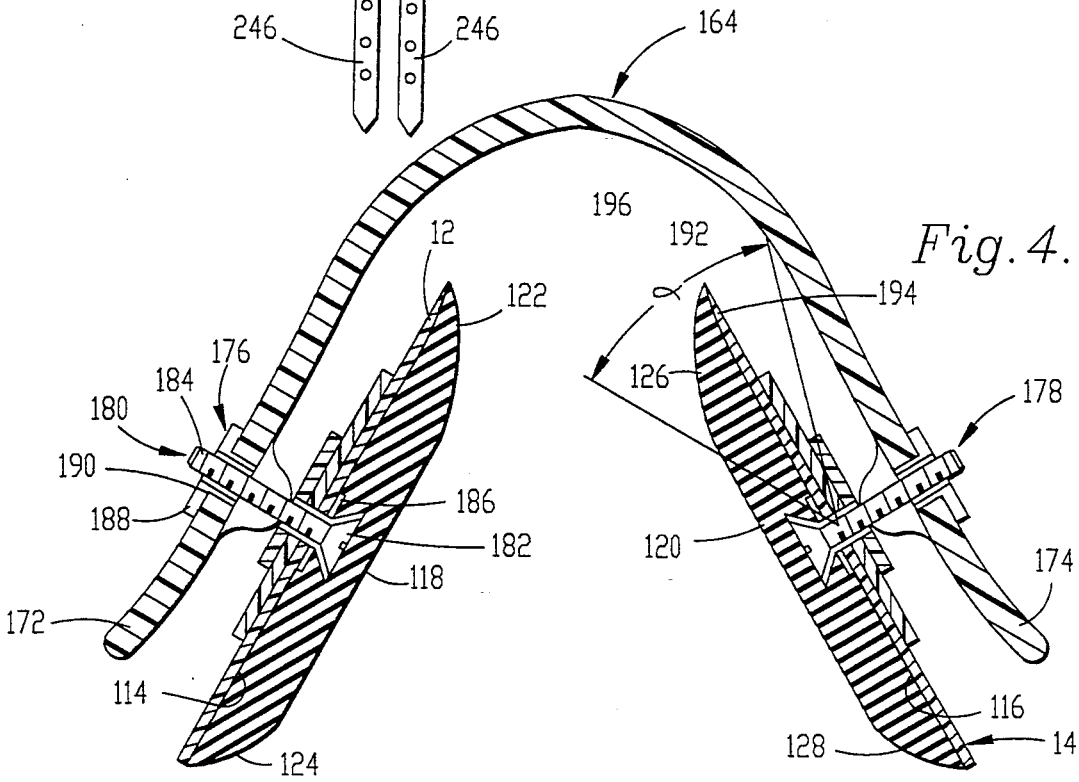
FIG. 4 is a sectional view taken along line 4—4 of FIG. 2 and illustrating the coupling assembly thereof.

Rearward portion 24 of skirt 12 includes an ovaloid reinforcing panel 108, which is adhesively affixed thereto. Mounting holes 110 and 112 extend through panel 108 and skirt 12. As can be seen from FIGS. 4, 5, and 6, skirts 12 and 14 have faces 114 and 116 which will normally present themselves towards the horse during use, and are completely covered with neoprene foam layers 118, 120 that are adhered to the respective faces. As is shown in FIG. 4, layers 118 and 120 present rounded edges at their laterally extending margins 122, 124, 126, and 128.

Figure 6:
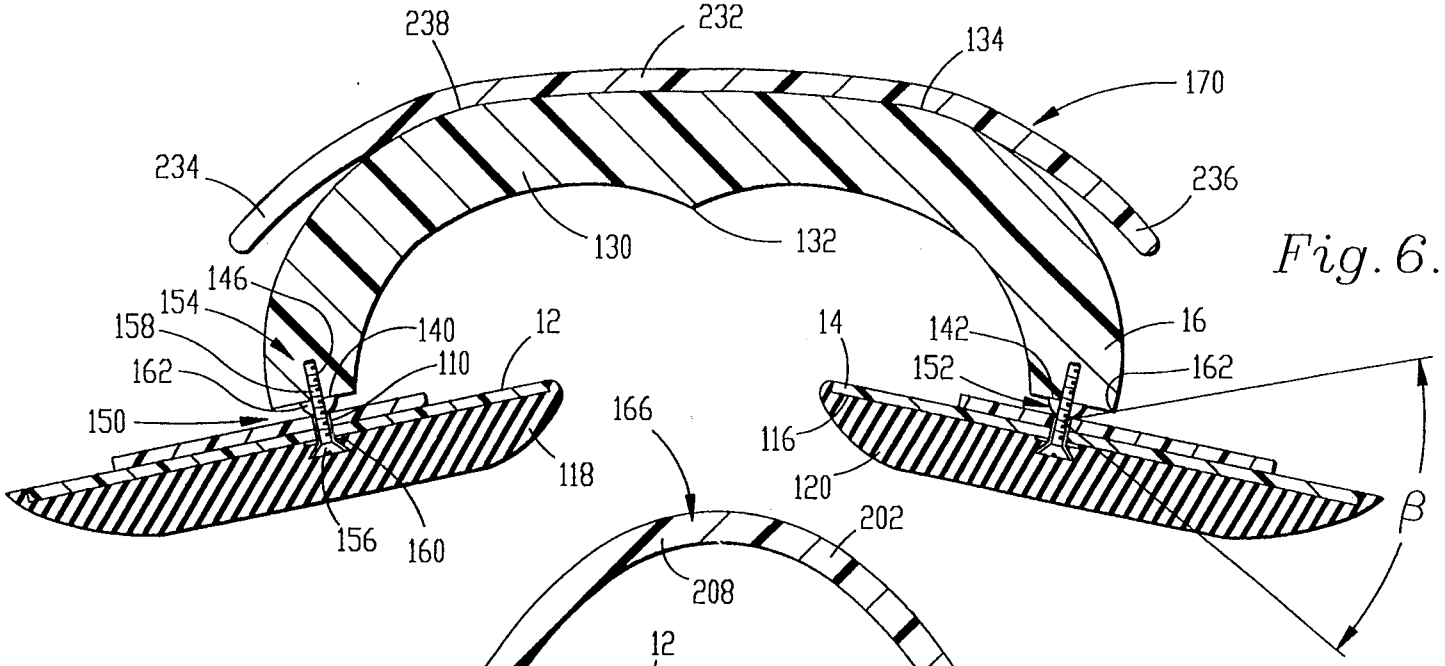
FIG. 6 is a sectional view taken along line 6—6 of FIG. 2 and illustrating the relationships between the seat member, spanning element, and skirts.

Turning now to FIG. 6, it is seen that spanning element 16 has a rounded, downwardly extending, symmetrical U-shaped central body portion 130 having a reinforcing ridge 132 at its lower middle, and presents an arcuate uppermost edge 134 having rounded edges along its forward and rearward margins 136 and 138 (see FIG. 2). Body 134 is bounded by flattened ends 140 and 142, which each have a laterally extending flattened ovaloid brace 144 (see FIG. 2) including steel reinforced threaded apertures 146 and 148. Brace 144 forms part of end 140, and end 142 presents a mirror image of brace 144.

Returning now to FIG. 6, assembly 150 is identical to assembly 152, thus, assembly 150 is now described by way of example. Assembly 150 includes stainless steel bolt 154 having tapered head 156 and threaded body 158. Head 156 is retained within a respective mounting hole, e.g., 110, by stainless steel flat washer 160, which restrains bolt 154 against outward movement into hole 110. Body 158 also passes through convex washer 162 and is received within a respective threaded aperture, e.g., 146. Hole 110 is widened to a greater diameter than threaded body 158, in order to permit vertical rocking motion of bolt 154 as head 156 pivots against washer 160.

As FIG. 6 depicts in the case of assembly 152, skirt 14 is permitted a range of rocking motion that encompasses angle $\beta$ extending downwardly from corner 162 over a range of between about 45° and 70°, most preferably, 55° to 60°. In the case of skirt 14, identical mounting assemblies pass through each of holes 110, and 112, as well as threaded apertures 146 and 148 of spanning element 16. These dual assemblies oppose lateral rocking motion in a forward to rearward direction, while defining an axis for the rocking motion that is permitted along angle $\beta$. Skirt 12 has a similar range of rocking motion to that of skirt 14.

FIG. 2 depicts seat element 18, which has pommel 164, skid assembly 166, seat portion 168, and cantle 170, all formed as a single piece from synthetic resin. As can be seen in FIG. 4, pommel 164 presents a symmetrical generally U-shaped crest connecting downwardly extending outwardly flared ends 172 and 174.

Two identical coupling assemblies 176 and 178 connect skirts 12 and 14 with pommel 164. By way of example, coupling assembly 176 includes bolt member 180 having tapered head 182 and threaded body 184. Head 182, is retained against outward movement into hole 98 by flat washer 186. Body 184 passes through respective mounting hole 98, through concave washer 186, and is received within threaded bushing 188. Mounting hole 98 has a greater diameter than does body 184 which allows pivotal motion of head 182 against washer 186. Bushing 188 is affixed within opening 190 of pommel 164.

As FIG. 4 illustrates in the case of coupling assembly 178, coupling assemblies 176, 178 each allow vertical rocking motion along angle $\alpha$, over a range between about 45° and 70° extending downwardly from position 192 where corner 194 contacts face 196. Additionally, an identical angular range of lateral rocking motion is permitted in a forward to rearward direction around the single respective bolts of the assemblies 176 and 178.

Figure 5:
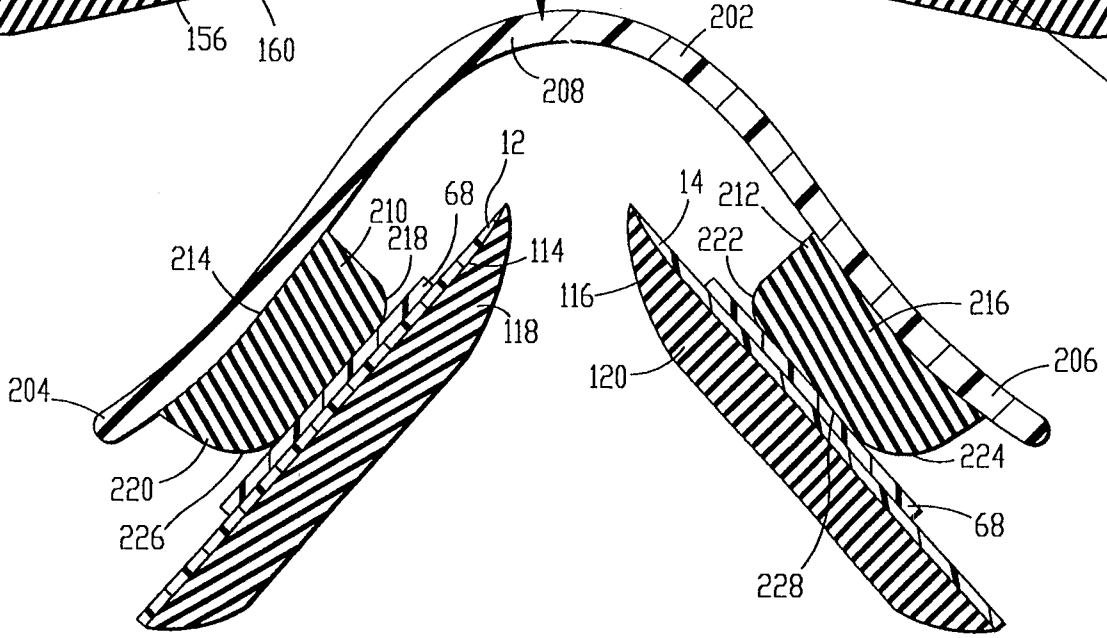
FIG. 5 is a sectional view taken along line 5—5 of FIG. 2 and illustrating the skid assembly thereof.

As seen in FIG. 2, the sectional view of flared end 172 narrows rearwardly along arrow 198 towards stirrup slot 200, and the next rearward sectional view (FIG. 5) depicts a thickening at skid assembly 166. FIG. 5 depicts skid assembly 166, which presents a symmetrical concave down, U-shaped ridge 202 bounded on opposed ends by outwardly flared sections 204 and 206. Downward face 208 is proximal to respective skirts 12 and 14. On face 208, ends 204 and 206 are adhesively coupled with cushions 210 and 212, which may be made of neoprene foam or other resiliently deformable elastomeric material. Cushions 210, 212 have respective flattened faces 214 and 216 which conform with ends 204, 206, and present rounded edges 218, 220, 222, and 224 leading down to respective lowermost flattened faces 226, 228. Faces 226 and 228 frictionally engage respective stiffening assemblies 68, which act as skid plates to frictionally oppose sliding forces and motions. As can be seen from FIG. 2, the sectional width of skid assembly 166 narrows rearwardly along arrow 230 to a minimum thickness across seat portion 168, and subsequently thickens towards the next sectional view (FIG. 6).

Seat portion 168 maintains a symmetrical downwardly extending U-shaped symmetrical cross section which, depending upon the type of synthetic resin employed, may be designed to have a cross sectional width or vertical thickness providing sufficient strength for supporting a rider of a given weight as, for example, to provide different saddles for children and adults. Portion 168 preferably has sufficient strength to maintain the weight of a rider at a starting position, and will resiliently flex under the influence of changing compressive loading forces as the horse moves.

Turning now to FIG. 6, cantle 170 presents a central body portion 232 connecting flared ends 234 and 236. Body 232 has lowermost face 238 that slidably engages uppermost surface 134 of spanning element 16, while ends 234 and 236 flair outwardly so as not to contact element 16.

FIG. 1 depicts tree 10 as it is covered with leather exterior material 240 in the style of an English saddle 242 including girth straps 244, 246, side flap 248, knee cushioning 250, and saddle tree covering 252. Additionally, other conventional items such as decorative stitching 254 may be placed on the covering.

In operation, saddle 242 is appropriately placed on a horse, and a rider may alternatively sit on top of seat portion 168 or stand on a conventional stirrup assembly that may hang from slot 200. Skirts 12 and 14 pivot and flex responsive to compressive loading thereof in progressive stages at coupling assembly 20, skid mount 166, and spanning element 16, thereby distributing the load over a large surface area conforming to the horse's back and shoulders.

The distributed loading forces change as tree 10 flexes in response to the horse's movements. Seat portion 168 is relatively more flexible than either pommel 164 or cantle 170, and moves responsive to the forces of normal horseback riding. These forces are transmitted between the horse and rider through tree 10. Fingers 28–38 are designed to flair outwardly to accommodate the shoulders of the horse, while projections 80–90 and strap 64 buttress the fingers, thereby enabling them to better distribute loading forces over the wither-shoulder region. Skirts 12 and 14 are respectively free to pivot within the range of angles $\alpha$ and $\beta$. Additionally, the respective middle portions of skirts 12 and 14 may be easily deformed to bow inwardly towards the horse, since skirts 12 and 14 are coupled with seat element 18 at coupling assembly 20, but skid assembly 166 and skirts 12, 14 are free to slide laterally relative to cantle 170. Stiffening assemblies 66 serve to distribute loading from coupling assembly 20 over the shoulder region of the horse by resisting against excessive deformation of the skirts that may concentrate too much weight at single point.

Tree 10 is readily deformable as described above, and also incorporates a damping system to prevent this flexibility from contributing to excessive oscillatory vibrations. As described above, normal horseback riding forces will induce resilient flexion in skirts 12, 14, and saddle element 18. This flexion serves as a shock absorber to reduce the maximum impact of such forces between the horse and the rider. The flexion is prevented from progressing towards uncontrolled oscillatory vibrations through the interplay of at least three damping means. First, a mechanical hysteresis damping is caused by the flexion of skirts 12 and 14, as well as seat element 18—particularly the deformable seat portion 168 and skid assembly 166. Second, flexion in portion 168 causes lateral sliding motion of cantle 170 over spanning element 134, where frictional forces will convert this vibrational energy into heat. Third, at skid assembly 166, elastomeric cushions 210 and 212 resiliently deform to absorb vibrational energy, and may also frictionally oppose forces that may cause the cushions to slid along the outer surface of skirt 12. The overall system by be designed to exhibit over damping (nonoscillatory vibrations), critical damping (a return to the rider's normal or starting position without overshoot), or oscillatory damping, as desired by adjusting the thickness of seat portion 168 depending upon the weight of the rider and the types of synthetic resin employed.

Whereas the invention has been described with reference to the illustrated preferred embodiment, it is noted that substitutions may be made and equivalents employed herein without departing from the scope of the invention as set forth in the claims.

I claim:

1. A damped saddle tree having progressively loaded spring panel skirts, comprising:

a pair of resilient skirts adapted to conformably overlie a horse's back, each skirt presenting a forward portion and a rearward portion;

a spanning element coupled with each of said skirts;

a seat member positioned above said skirts and slidably engaging said spanning element;

means for coupling said seat member to said skirts in a manner allowing pivotal and sliding motions;

said seat member having a resiliently deformable region intermediate said forward and rearward portions, said deformable region having less rigidity than said pommel and cantle portions and including means for damping vibrations traveling between a horse and rider.

2. The saddle tree as set forth in claim 1, each of said skirts including a forward portion having a plurality of forwardly extending fingers.

3. The saddle tree as set forth in claim 2, further including a flexible strap interconnecting said fingers.

4. The saddle tree as set forth in claims 1, said each of said skirts including a stiffener affixed to a portion thereof.

5. The saddle tree as set forth in claim 4, including said stiffener panel affixed to said forward portion.

6. The saddle tree as set forth in claim 1, including said spanning element coupled with said skirts across respective rearward areas thereof.

7. The saddle tree as set forth in claim 6, including said coupling means positioned forward of said spanning member.

8. The saddle tree as set forth in claim 1, said coupling means including a synthetic resin sheet having structure defining an elongated slot there through and affixed to said skirt proximal to said seat member, a rounded knob affixed to said seat portion proximal to said skirt and having structure defining a central threaded aperture, and a stud member having a head retained within said slot and a threaded body retained within said aperture.

9. The saddle tree as set forth in claim 1, said damping means including a skid assembly positioned on each skirt intermediate said spanning element and said coupling means.

10. The saddle tree as set forth in claim 9, said skid assembly including a elastomeric cushion extending downwardly from said seat portion to contact said skirt.

11. The saddle tree as set forth in claim 10, said cushion providing means for absorbing shocks and for distributing a compressive load onto said skid plate.

12. The saddle tree as set forth in claim 11, said seat having a stirrup mounting structure positioned intermediate said skid assembly and said coupling means.

* * * * *